US009951568B2

(12) United States Patent
Brown et al.

(10) Patent No.: US 9,951,568 B2
(45) Date of Patent: Apr. 24, 2018

(54) WELL LINER

(71) Applicant: JOHNSON MATTHEY PUBLIC LIMITED COMPANY, London (GB)

(72) Inventors: Stuart Brown, Aberdeen (GB); Paul Hewitt, Pasadena, TX (US)

(73) Assignee: Johnson Matthey Public Company Limited, London, England (GB)

( * ) Notice: Subject to any disclaimer, the term of this patent is extended or adjusted under 35 U.S.C. 154(b) by 147 days.

(21) Appl. No.: 14/901,505

(22) PCT Filed: Jun. 27, 2014

(86) PCT No.: PCT/GB2014/051975

§ 371 (c)(1),
(2) Date: Dec. 28, 2015

(87) PCT Pub. No.: WO2014/207483

PCT Pub. Date: Dec. 31, 2014

(65) Prior Publication Data

US 2016/0153246 A1 Jun. 2, 2016

(30) Foreign Application Priority Data

Jun. 28, 2013 (GB) ..... 1311609.0

(51) Int. Cl.
*E21B 17/00* (2006.01)
*E21B 43/10* (2006.01)
(Continued)

(52) U.S. Cl.
CPC ..... *E21B 17/00* (2013.01); *E21B 43/10* (2013.01); *E21B 43/116* (2013.01); *E21B 47/1015* (2013.01)

(58) Field of Classification Search
CPC ..... E21B 17/00; E21B 43/10; E21B 43/116; E21B 43/08; E21B 47/10; E21B 47/1015
See application file for complete search history.

(56) References Cited

U.S. PATENT DOCUMENTS 3,623,842 A 11/1971 Deans
4,755,469 A 7/1988 Showalter et al.
(Continued)

FOREIGN PATENT DOCUMENTS

EP 1 991 759 B1 10/2010
WO 2004/097155 A2 11/2004
(Continued)

OTHER PUBLICATIONS

United Kingdom Combined Search and Examination Report GB1411521.6 dated Dec. 9, 2014.
(Continued)

*Primary Examiner* — D. Andrews
*Assistant Examiner* — Dany E Akakpo
(74) *Attorney, Agent, or Firm* — Baker & Hostetler LLP

(57) ABSTRACT

A tracer-liner portion includes an inner tube and an outer tube, each including at least one wall having an internal surface and an external surface, the walls of the inner tube and the outer tube being impermeable to fluid flow, the outer tube having an internal diameter which is larger than the outer diameter of the inner tube, the inner tube being arranged coaxially within the outer tube such that at least a portion of the external surface of the inner tube is covered by the outer tube; the internal diameter of the outer tube exceeds the outer diameter of the inner tube by an amount sufficient to form a space between the external surface of the inner tube and the internal surface of the outer tube, and a tracer material containing a tracer compound is present in the space.

9 Claims, 2 Drawing Sheets

Figure 1:
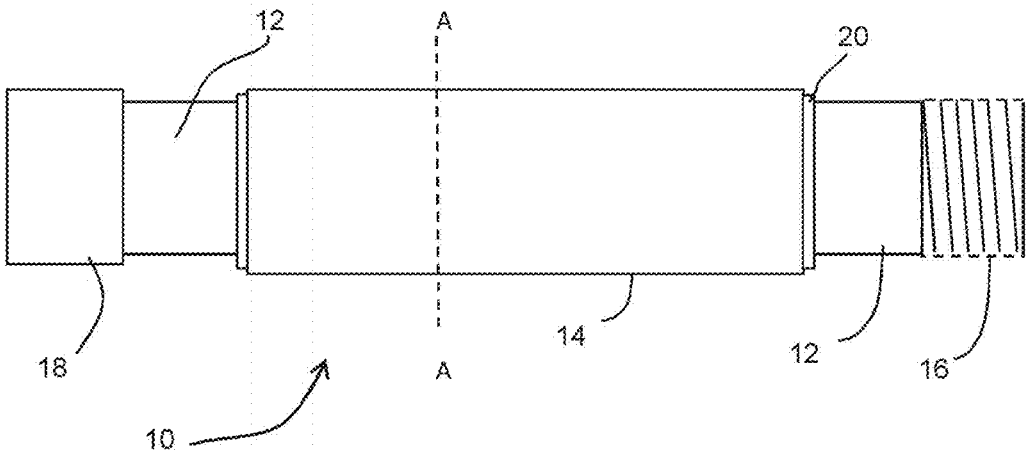

(51) Int. Cl.
*E21B 43/116* (2006.01)
*E21B 47/10* (2012.01)

(56) References Cited

U.S. PATENT DOCUMENTS

| | | | | |
|---|---|---|---|---|
| 5,077,471 | A | 12/1991 | Smith, Jr. et al. | |
| 6,645,769 | B2 | 11/2003 | Tayebi et al. | |
| 6,672,385 | B2 | 1/2004 | Kilaas et al. | |
| 7,334,486 | B1 | 2/2008 | Klammler et al. | |
| 9,290,689 | B2 * | 3/2016 | Lafitte | C09K 8/62 |
| 2006/0048935 | A1 | 3/2006 | Kristiansen | |
| 2007/0295511 | A1 | 12/2007 | Johnson et al. | |
| 2011/0024111 | A1 * | 2/2011 | Moen | E21B 43/08 166/278 |

FOREIGN PATENT DOCUMENTS

| | | | |
|---|---|---|---|
| WO | 2011/005988 | A1 | 1/2011 |
| WO | 2011/153635 | A1 | 12/2011 |
| WO | 2011/153636 | A1 | 12/2011 |

OTHER PUBLICATIONS

United Kingdom Search Report GB1311609.0 dated Dec. 17, 2013.
International Search Report, dated Jul. 10, 2015, from corresponding PCT Application.

* cited by examiner

WELL LINER

The present invention concerns a liner for a well having a tracer system incorporated therein.

In the oil and gas production industries, when a well is drilled through earth formations including oil and gas reservoirs, it is common to line the well with a liner or casing, i.e. a pipe, usually formed of metal. The liner has various functions, including protecting the borehole from unstable rock formations and protecting the rock formations from production chemicals and produced fluids flowing in the borehole. It also provides a regular and stable path for the insertion of tools required for the operation of the well. The liner or casing is usually formed from sections of metal pipe assembled and installed during completion of the well. Well liners are cemented in place by filling the gap between the sides of the borehole and the external wall of the liner with cement. In a typical well drilling and completion operation, a well bore is drilled using a drill bit though the target reservoir zone. The drill is pulled and tubing forming the liner or casing is run that is smaller than the well bore through the drilled area. Once in position and centralized within the well bore, a batch of cement is pumped into the inner tubing with a small movable plug at the top. It is then pushed with fluid with cement flowing to the very end of the tubing and then forced between the well bore and outer wall of the tubing. The cement plug is pushed to the end of the tubing and stopped. The plug acts as a barrier between cement and "push" fluid and in being pushed down the borehole "wipes" the inner walls of the tubing as it goes. Once the tubing is cemented into place and the cement has fully cured, perforation guns are sent down hole to penetrate through the steel, cement and into the formation at hydrocarbon producing intervals to allow fluid flow.

It is well known to place tracers in a well in order to detect flow of fluid from a part of the well where a tracer has been placed. For example, European Patent Number 1991759 describes a method of monitoring the flow of fluid within or from a reservoir comprising the steps of inserting a solid non-radioactive tracer into the reservoir by means of a perforation tool, thereafter collecting a sample of fluid within or flowing from the reservoir and analysing said sample to determine the amount of said tracer contained in the sample. From the presence or absence of tracer in the sample, its amount and other parameters such as timing of the sample collection etc, information about the fluid flow within the reservoir may be gathered. U.S. Pat. No. 3,623,842 describes a method of determining fluid saturations in reservoirs by injecting at least two tracers having different partition coefficients between fluid phases (e.g. oil and water) into the formation and monitoring the appearance of the two tracers in the produced fluids. Radioactive tracers have been widely used for many years in well-monitoring applications. As an example, see U.S. Pat. No. 5,077,471, in which radioactive tracers are injected into a perforated well-bore, sealed and then monitored for decay to indicate the fluid flow from the formation. U.S. Pat. No. 4,755,469 describes the use of rare metal tracers for tracing oil and associated reservoir fluids by mixing an oil-dispersible rare metal salt with oil or an oil-like composition, injecting the dissolved tracer composition into a subterranean reservoir and analysing oil fluids produced from a different part of the reservoir for the presence of the rare metal to determine whether the oil mixed with the tracer has been produced from the reservoir. U.S. Pat. No. 6,645,769 describes placing different tracers at different parts of the well by adhering polymeric tracers to parts of the completion apparatus so that the tracers may be carried with a fluid as it flows to the well-head.

It would be very desirable to associate tracers with liner tubing before it is installed in the well because incorporation of the tracer could then be carried out under controlled conditions away from the well drilling operation in order that accurate placement within the wellbore could be achieved. Well tubing with tracer provision has been described in U.S. Pat. No. 6,672,385 in which a combined prefabricated liner and matrix system with defined properties for fast and simple well and/or reservoir completion, monitoring and control is provided. An embodiment of the combined prefabricated liner and matrix system comprises an outer perforated tubular pipe/pipe system, an inner tubular screen, and a matrix. WO2011/153636 describes a wellbore screen including: an apertured base pipe; an intermediate filtering layer including a plurality of metal fibers wrapped helically around the apertured base pipe and a fluid tracing filament wrapped helically about the apertured base pipe, the fluid tracing filament including a filament structure and a tracer carried by the filament structure, the tracer being entrainable in produced fluids in a wellbore environment; and an outer apertured shell over the intermediate layer. A problem with these tracer/liner systems is that in the process of cementing the liner in place in which cement is pushed along the inner bore and up the outer wall of the liner, the apertures, which are intended to allow fluid flow, would become blocked with cement, thereby preventing contact of the tracer and well fluids and possibly also reducing the fluid flow as the apertures become blocked. Furthermore, it is not practical to place tracer material within the bore of the liner because the material may interfere with the flow of the cement or the cement plug and may also be disturbed or removed by the cementing operation. It is an object of the present invention to provide a liner with a tracer system that is cementable and overcomes some of the problems of the prior art.

According to the invention a tracer-liner portion comprises an inner tube and an outer tube, each comprising at least one wall having an internal surface and an external surface, and a tracer material, said inner tube being arranged coaxially within said outer tube such that at least a portion of the external surface of said inner tube is covered by said outer tube, and said tracer material is arranged between the internal surface of said outer tube and the external surface of said inner tube, wherein the walls of the inner tube and the outer tube are impermeable to fluid flow.

The walls of the inner tube and the outer tube are impermeable to fluid flow during fabrication and installation of the liner. They are not provided with perforations or apertures in contrast to prior art systems. This has the advantage that there is no fluid flow system to become blocked during a cementing operation and that the tracer-liner portion of the invention is suitable for use in forming a cemented liner for a well-bore. When the tracer-liner portion of the invention is installed in a well as part of a well liner which has been cemented in place, perforations may be formed in the inner and/or the outer tubes so that fluid flowing within or over the liner may contact the tracer material located between the inner and outer tubes. This is conveniently achieved using a perforation tool. A perforation tool carrying explosive charges may be inserted into the inner tube of the liner portion and its explosive charges detonated to perforate the liner and the surrounding rock formation. Thereafter, fluid flowing along the liner, or through the liner from the adjacent rock formation, may contact the tracer material through the perforations thus formed and the tracer material may thereby be incorporated into the fluid flow, to be detected downstream of the tracer-liner portion.

A well liner according to the invention comprises a plurality of liner portions, each joined at at least one end to an adjacent liner portion, at least one of said liner portions comprising a tracer-liner portion of the invention. The tracer-liner portion of the invention is intended to form a part of a longer well-liner when it has been assembled with other liner portions. A well-liner according to the invention may comprise more than one tracer-liner portion of the invention, but usually a well-liner comprises at least some other types of liner portion, for example formed from tubing which has no associated tracer materials.

The tracer-liner portion includes means for joining it to an adjacent liner portion at each end. Well-liners formed from liner portions are conventional in the art and the joining means of the tracer-liner portion may comprise any such means which is already known or which may be developed for joining portions of well liner together. Such means preferably comprises threaded portions at each end of the liner portion which cooperate with a threaded portion of an adjacent liner portion. For example, the well liner portion may be provided with an internally threaded portion at one end and an externally threaded portion at the other end. The joining means provide at the end(s) of the tracer-liner portion very preferably is selected to be of a similar type to and to cooperate with the joining means for the liner portions to which it is intended to be joined to assemble the well-liner of which it will form a part.

The inner tube is preferably formed from metal, especially steel. The inner tube is conveniently selected to be of a similar type to the tubing conventionally used for lining or casing a well. For use in any particular well-liner the inner tube of the tracer-liner portion is preferably selected to be of the same inner diameter and material as other parts of the liner, particularly liner portions which are adjacent to the tracer-liner portions of the invention, in order that the passage of tools and fluids through the liner is uninterrupted. Therefore the inner tube is preferably selected from standard base liner stock which is available for use in the oil and gas industry. The outer tube is also preferably formed from metal. The length of the inner tube is not critical and may be varied to suit the application. It may be convenient to form the inner tube from a length of tubing which is a standard length or of a similar length to the other liner portions used to form the well-liner. Alternatively the inner tube may be longer or, more usually, shorter than the length of adjacent liner portions.

The outer tube has an internal diameter which is larger than the outer diameter of the inner tube. The internal diameter of the outer tube exceeds the outer diameter of the inner tube by an amount sufficient to form a space in which the tracer material is located. When both inner and outer tubes are circular, the space between them forms an annulus. The tracer material may fill the space between the inner and outer tubes but in preferred embodiments the tracer material does not fill the space. In these embodiments fluid can flow within the space, thereby increasing the contact time between the fluid and the tracer material compared with embodiments in which the space is filled with tracer material. The space between the inner and outer tubes is sealed at each end of the outer tube. The space may, optionally, be divided along its length if required.

In a preferred embodiment, the tracer-liner portion comprises an inner tube, an outer tube and spacers provided between the external surface of the wall of the inner tube and the outer tube, the dimensions of the spacers defining the space between the inner and outer tubes. The spacers are preferably joined to the inner and outer tubes to form a seal. The spacers are preferably made of metal and may comprise rings which may be joined to the inner and/or outer tubes by means of welding or other means such as threads or flanges.

The tracer material comprises a tracer compound and optionally a matrix material. The tracer compound may be any compound which can be carried in the flow of fluid through the liner and which is detectable by an appropriate method downstream. The range of tracer compounds which may be used is large. The type of tracer compound to be used is limited only by its physical form and detectability by a practical method. In principle, any tracer compound could be used in the tracer-liner portion of the invention, provided it can be placed within the space between the outer and inner tubes. The compound is most conveniently a solid compound although liquid compounds may be used if they can be handled and placed in the space between the inner and outer tubes, or if they can be adapted to a form which is handleable and placeable, for example by mixing with or absorption by a solid material. The tracer compound may comprise a dye which can be detected by visual means or by a spectroscopic method. The dye may be coloured or not coloured to the eye. Fluorescent compounds, detectable by fluorescence spectroscopy, are well-known for use as tracers and may be suitable for this application. Chemical tracer compounds which are detected by atomic absorption spectroscopy or other methods may be used. The tracer compound may be soluble in the fluid flowing in the well or it may be carried in the flow as a particle. The tracer compound may be selected to partition into an organic phase or into an aqueous phase such as in the water co-produced in an oil or gas well. The selection of suitable tracer compounds is known in the art and the skilled person is capable of selecting one or more appropriate tracer compounds. More than one tracer compound may be used within the same tracer material. For example, different combinations of tracers may be used to identify different tracer-liner portions. When more than one tracer-liner is used within a well or a section of a well, they may contain different tracer compounds or combinations of tracer compounds so that fluid passing through each tracer-liner may be identified.

The tracer compound may be dispersed in a matrix material. The combination of tracer compound and matrix material may be a solid tracer material. The matrix material may be a solid material such as a polymeric material, paint, wax or bituminous material. The tracer may be chemically bound to the matrix or may simply be physically dispersed therein. When the tracer material comprises a matrix, the tracer is typically released into fluid flowing past the material by dissolution of either the matrix material or the tracer compound in the fluid. Alternatively the matrix may be selected to degrade in a controlled manner on contact with the fluid, for example by hydrolysis of a hydrolytically unstable polymer matrix. The dissolution or degradation mechanism may be enhanced by the conditions of temperature and pressure found in the well. The use of delayed or controlled release tracer materials is preferred in some embodiments of the tracer-liner of the invention to provide a traceable flow over a longer period. However in some cases it is only required to trace a flow over a short period, for example to determine if a perforation operation has resulted in a successful fluid flow. Therefore the selection of tracer material depends upon the job in which the tracer-liner is to be used. When different tracer materials are used in the same or different tracer-liners within a well, they may be designed to be released at different rates by appropriate selection of one or more matrices or other means to provide delayed or controlled release. For example, a tracer-liner of the invention may contain a tracer material which is released rapidly on contact with a fluid and one or more additional tracer materials which are designed to release tracer over a longer period of time. In this way fluid contacting the tracer materials in the tracer-liner may be detected at different stages in the production history of the well. The tracer compounds in each tracer material may be the same or different. Different tracer materials may be visually coloured or otherwise marked in order to identify them during assembly of the tracer-liner.

The tracer material comprising a tracer compound and a solid matrix material in the form of a solid tracer material may be fixed to the outer surface of the inner pipe or it may be fixed to the inner surface of the outer pipe. Alternatively, but less desirably, a loose tracer liquid or particulate tracer compound may be filled into the space between the inner and outer tubes. The tracer may extend around the circumference of the inner pipe in a continuous layer or it may alternatively be discontinuous. For example a tracer material dispersed in a settable matrix material may be applied to the outside of the inner tube by printing, painting or coating and then cured or dried in place. Alternatively a tracer compound may be dispersed in a solid matrix to form solid tracer blocks or sheets. Tracer materials in that form may then be attached to the inner or the outer tube surfaces by means of adhesives or by clips or ties. As a further alternative, tracer in the form of fibres or an elongate tape or sheet may be wrapped around the inner tube. The tracer material may be selected or treated to provide a surface which attracts the fluid or a selected portion of the fluid. For example a solid polymeric matrix containing tracer may have a hydrophilic or hydrophobic surface depending on whether the tracer is intended to be released into an organic or aqueous fluid.

When the tracer material is a solid, for example formed as a block or sheet, it may be provided with surface features such as a textured surface and/or ribs, channels, protrusions and bosses to promote flow over the surface of the tracer. The solid tracer blocks or sheets are shaped to fit into the space between the outer and inner tubes and may include particular adaptations to enable them to be fitted into the space. For example, the tracer material may take the form of a mat or sheet formed of a polymeric matrix material incorporating a dispersed phase of a tracer compound. Preferably the sheets or mats are flexible in at least one direction. Sheets of material have two opposing major surfaces separated by the thickness of the sheet and bounded by one or more minor surfaces. The sheets of tracer material may include incisions or channels extending from a major surface thereof towards the other major surface. The incisions or channels may extend completely through the thickness of the sheet or they may extend only partially through the thickness of the sheet. Incisions or channels may be provided on both major surfaces or only one. A sheet of tracer material may incorporate linear channels extending partially through the thickness of the sheet. The channels may extend between one edge of the sheet and an opposed edge. The channels allow the sheet to be formed around a curved shape such as a pipe or tube so that the external surface of the sheet containing the channels can deform to accommodate an external curve. When the sheet is formed into such a curved shape, the channels open, thereby providing means for fluid flow along the sheet and an increased surface area for the fluid to contact the tracer.

A tracer material in the form of a sheet or block may include ribs, bosses or other protrusions extending outwardly from one major surface thereof in a direction away from the other major surface, i.e. to protrude from a major surface of the sheet. A "rib" in the context of this patent application means a generally elongate protrusion or projection extending outwardly from a surface. A rib may, but need not, extend continuously or discontinuously from an edge of a sheet to the same or another edge of a sheet. A rib may be of uniform dimension or shape along its length. A rib may taper to a smaller dimension at a distance further from the surface of the sheet than its corresponding dimension nearer to the sheet. For example the width of a rib may become smaller as its height, or distance from the surface, increases. A "boss" or "embossment" is intended to mean a protrusion or projection from a surface of the sheet. A boss may, for example take the form of a generally circular, irregular or polyhedral shaped portion of the sheet extending outwardly from a major surface of the sheet. Ribs, bosses or other protrusions may be present on both major surfaces of the sheet. A sheet of tracer material may possess at least one channel or incision and also at least one rib, protrusion or boss. Ribs may be straight or curved. Ribs may be parallel to each other.

The sheet may be flexible. The tracer in the form of a solid tracer material may be otherwise adapted to conform to the shape of a space between the internal surface of said outer tube and the external surface of said inner tube. The sheet may be fixed into position around the outer surface of the inner tube using cable ties, for example.

A method of tracing flow from a subterranean well comprising a well bore penetrating a fluid-bearing rock formation, according to the invention, comprises the steps of: inserting a well-liner into said well, said well-liner comprising a plurality of liner portions, each joined at at least one end to an adjacent liner portion, wherein at least one of said liner portions comprises a tracer-liner portion according to the invention, the outer wall of said well liner and the inner surface of said well-bore defining a gap, filling said gap with a settable fluid material and thereafter allowing said fluid material to set to form a solid material; forming perforations in the inner and outer tubes and the solid material so that fluid flowing within or over the liner may contact the tracer material located between the inner and outer tubes; collecting a sample of fluid at a location downstream of said perforations; analysing said sample to determine whether said tracer compound is present; and inferring from the presence or absence of said tracer compound in the sample whether fluid has contacted the tracer or flowed from said rock formation in the region of said perforations. The settable fluid material may be a well cement.

The invention will be further described, by way of example, with reference to the accompanying drawings, which are:—

Figure 2:
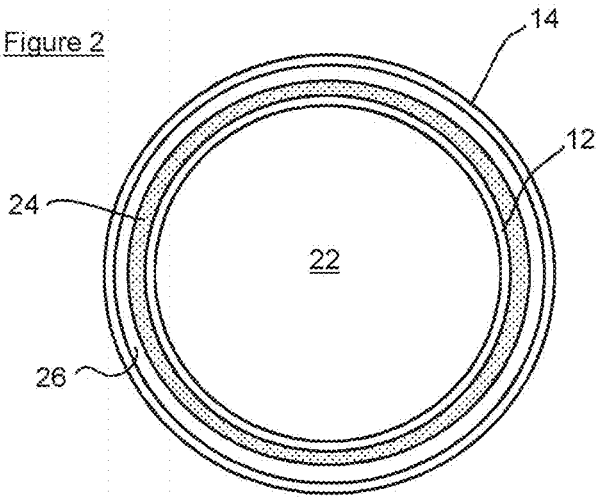

FIG. 1: a schematic view of a tracer-liner portion according to the invention;

FIG. 2: a section through the tracer-liner portion of FIG. 1 along line A-A.

Figure 3:
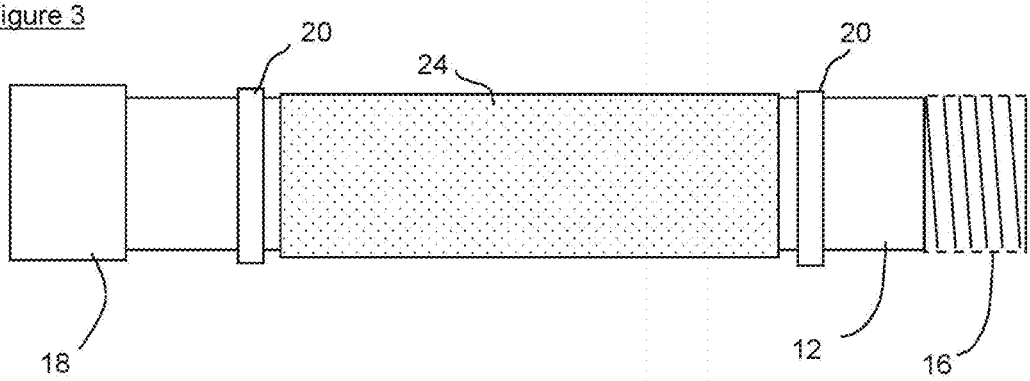
Figure 4:
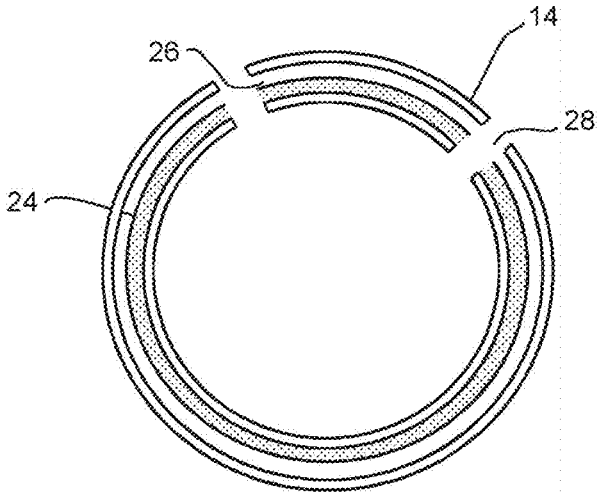

FIG. 3: a schematic view of a part of a tracer-liner portion according to the invention;

FIG. 4: a section through the tracer-liner portion of FIG. 1 along line A-A showing perforations.

FIGS. 1 and 2 show a tracer-liner portion according to the invention 10. The tracer-liner portion comprises an inner steel pipe having a 5.5 inch (140 mm) inside diameter 12 and an outer steel pipe 14 having an inside diameter of approx.

6.4 inches (163 mm). The pipes are formed from high strength steel of the type specified for well liner fabrication. Inner pipe 12 is provided with threaded ends 16 (external thread) and 18 (internal thread). Threaded portions 16 and 18 are capable of engaging with threaded portions of adjacent pipes so that an elongate well-liner may be constructed by joining adjacent pipes together by means of the threaded portions. The pipe 12 is very conveniently a standard liner pipe which is provided with standard threaded portions for joining to standard liner pipes used in the industry. 5.5 inch (140 mm) internal diameter steel rings 20, welded to the outside of pipe 12, form spacers to which the inside of pipe 14 is joined at each end. A cavity is present between the outer and inner pipes, the cavity being bounded at each end by the spacer rings 20. Part of the cavity is filled with a slow-release, polymeric tracer material 24. The remainder of the cavity forms an annular gap 26, about 0.09 inch (2.5 mm) wide, between the outer pipe 14 and the tracer material.

FIG. 3 shows an internal view of the tracer-liner portion of FIG. 1 without the outer tube. Steel spacer rings 20 are shown in position on the inner pipe 12. A layer of tracer material 24 is fixed around the outside of the inner pipe between the spacer rings. The outer pipe is then welded to the outer circumference of the rings 20.

In-use, the tracer-liner portion is assembled into a well-liner by joining it to adjacent liner portions which need not be tracer-liner portions. The cementing operation is carried out when the assembled liner is in position in a borehole by passing the cement and cement plug into the lumen 22 of the liner and forcing the cement under pressure into the annulus between the walls of a borehole and the outside of the liner. The liner may be perforated in a subsequent perforation operation. As shown in FIG. 4, perforation of the inner and outer tubes of the tracer-liner portion forms apertures 28 which allow the ingress of fluids into the gap 26 where the fluids contact the tracer material 24. Release of some tracer material into the fluids as a result of such contact then allows the tracer to be detected down-stream of the tracer-liner portion, which may provide information concerning the source or flow path of the fluid containing the tracer.

The invention claimed is:

1. A method of tracing flow from a subterranean well comprising a well bore penetrating a fluid-bearing rock formation, comprising the steps of:

a. inserting a well-liner into said well, said well-liner comprising a plurality of liner portions, each joined at at least one end to an adjacent liner portion, wherein at least one of said liner portions comprises a tracer-liner portion comprising an inner tube and an outer tube, each comprising at least one wall having an internal surface and an external surface, the walls of the inner tube and the outer tube being impermeable to fluid flow, said outer tube having an internal diameter which is larger than the outer diameter of said inner tube, said inner tube being arranged coaxially within said outer tube such that at least a portion of the external surface of said inner tube is covered by said outer tube; wherein the internal diameter of the outer tube exceeds the outer diameter of the inner tube by an amount sufficient to form a space between the external surface of the inner tube and the internal surface of the outer tube, and a tracer material containing a tracer compound is present in said space, the outer wall of said well liner and the inner surface of said well-bore defining a gap, b. filling said gap with a settable fluid material and thereafter allowing said fluid material to set to form a solid material;

c. forming perforations in the inner and outer tubes and the solid material so that fluid flowing within or over the liner may contact the tracer material located between the inner and outer tubes;

d. collecting a sample of fluid at a location downstream of said perforations;

e. analysing said sample to determine whether said tracer compound is present; and f. inferring from the presence or absence of said tracer compound in the sample whether fluid has contacted the tracer in the region of said perforations, wherein said tracer material is a solid tracer material and does not fill said space and the fluid flows within the space, and wherein said tracer material is a sheet of tracer material incorporating linear channels extending partially through the thickness of the sheet such that, when the sheet is formed into a curved shape around the inner tube, the channels open, thereby providing means for fluid flow along the sheet and an increased surface area for the fluid to contact the tracer material.

2. The method according to claim 1, wherein said perforations are formed by inserting a perforation tool carrying explosive charges into the inner tube of the liner portion and detonating the explosive charges.

3. The method according to claim 1, wherein the tracer-liner portion further comprises at least one spacer between the external surface of the wall of the inner tube and the outer tube.

4. The method according to claim 1, wherein said tracer material comprises a tracer compound and a solid matrix material.

5. The method according to claim 4 wherein said solid matrix material is selected from the group consisting of a polymeric material, paint, a wax or a bituminous material.

6. The method according to claim 4, wherein said tracer material comprises a tracer compound dispersed in a solid polymeric matrix in the form of a sheet.

7. The method according to claim 6, wherein said sheet has a textured surface.

8. The method according to claim 6 wherein the surface of said solid polymeric matrix incorporates at least one topographical feature selected from ribs, channels and protrusions.

9. A well liner comprising a plurality of liner portions, each joined at at least one end to an adjacent liner portion, wherein at least one of said liner portions comprises a tracer-liner portion comprising an inner tube and an outer tube, each comprising at least one wall having an internal surface and an external surface, the walls of the inner tube and the outer tube being impermeable to fluid flow, said outer tube having an internal diameter which is larger than the outer diameter of said inner tube, said inner tube being arranged coaxially within said outer tube such that at least a portion of the external surface of said inner tube is covered by said outer tube; wherein the internal diameter of the outer tube exceeds the outer diameter of the inner tube by an amount sufficient to form a space between the external surface of the inner tube and the internal surface of the outer tube, and a tracer material containing a tracer compound is present in said space; wherein said tracer material is a solid tracer material and does not fill said space and fluid can flow within the space, and, wherein said tracer material is a sheet of tracer material incorporating linear channels extending partially through the thickness of the sheet such that, when the sheet is formed into a curved shape around the inner tube, the channels open, thereby providing means for fluid flow along the sheet and an increased surface area for the fluid to contact the tracer material.

* * * * *